US006351980B1

(12) United States Patent
Jowitt et al.

(10) Patent No.: US 6,351,980 B1
(45) Date of Patent: Mar. 5, 2002

(54) BASE FORMING

(75) Inventors: Frederick William Jowitt, Yorks; Ian Kenneth Scholey, Wakefield; William Woulds, Shipley, all of (GB)

(73) Assignee: Crown Cork & Seal Technologies Corporation, Alsip, IL (US)

( * ) Notice: Subject to any disclaimer, the term of this patent is extended or adjusted under 35 U.S.C. 154(b) by 0 days.

(21) Appl. No.: 09/508,568

(22) PCT Filed: Sep. 14, 1998

(86) PCT No.: PCT/GB98/02781

§ 371 Date: Mar. 14, 2000

§ 102(e) Date: Mar. 14, 2000

(87) PCT Pub. No.: WO99/14000

PCT Pub. Date: Mar. 25, 1999

(30) Foreign Application Priority Data

Sep. 16, 1997 (GB) ..... 9719549

(51) Int. Cl.[7] ..... B21D 22/30

(52) U.S. Cl. ..... 72/348; 72/466.8

(58) Field of Search ..... 72/348, 349, 354.8, 72/465.1, 466.7, 466.8, 466.9; 413/69

(56) References Cited

U.S. PATENT DOCUMENTS

| | | | | | |
|---|---|---|---|---|---|
| 2,441,790 | A | * | 5/1948 | Bolte et al. | 72/354.8 |
| 3,760,751 | A | * | 9/1973 | Dunn et al. | 72/348 |
| 4,372,143 | A | | 2/1983 | Elert et al. | |
| 4,589,270 | A | * | 5/1986 | Lee, Jr. et al. | 72/348 |
| 4,620,434 | A | | 11/1986 | Pulciano et al. | |
| 5,797,292 | A | * | 8/1998 | Johansson et al. | 72/348 |
| 6,032,505 | A | * | 3/2000 | Stodd | 72/336 |

FOREIGN PATENT DOCUMENTS

| | | |
|---|---|---|
| GB | 2256388 | 12/1992 |
| WO | WO97/41978 | 11/1997 |

* cited by examiner

*Primary Examiner*—Lowell A. Larson
(74) *Attorney, Agent, or Firm*—Diller, Ramik & Wight

(57) ABSTRACT

A method and apparatus for forming the base of a can are described. The base forming apparatus is typically a dome station for forming a dome on the base of a beverage can. The dome station is mountable onto a dome door of a bodymaker press, thereby avoiding the common failure of mounting bolts. A complete polyurethane ring (20) is used to create overtravel force and maintain consistent and symmetrical loading on the tooling. A compact biasing arrangement is used to simplify maintenance of the tooling and reduce the need for accurate alignment.

19 Claims, 5 Drawing Sheets

BASE FORMING

BACKGROUND OF THE INVENTION

This invention relates to base forming. In particular, it relates to an apparatus for forming the base of a can as it is carried on a punch of a can bodymaker.

The can bodymaker takes a formed cup and then draws and irons the cup to produce a can body. The cup is carried on a punch which passes through a series of draw and ironing rings, finally forcing the can body against a base forming apparatus. Such base forming apparatus is used for forming domed profiles on the base of a can where the base needs to be able to withstand high internal pressures, particularly for carbonated beverages. In this case, the apparatus is commonly referred to as a "doming station" or "domer".

Doming stations are traditionally high wear items which need repair or replacement much more frequently than do other bodymaker tool parts. Since the domer must be able to withstand the force of the punch carrying the can as the punch reaches the end of its stroke, failure has been commonly found in the moving parts and components which provide a reactive force to counteract the punch force. Further failure has been common in bolts which carry the domer since these bolts take any excess force during the doming cycle.

It is increasingly desirable to produce cans from lightweight materials in order to reduce material costs. However, as the materials used become thinner, so the performance of the base profile becomes more critical. The dome produced must be able to withstand not only high internal pressures but also show good drop resistance. It is thus ever more important that the tolerances of the base profiles are tight and that consistent results are obtainable from the press and, in particular from the domer.

In order to ensure that these tight tolerances are obtained consistently, it is important that the doming station is accurately aligned and that forces within the structure of the doming station are evenly distributed. Thus, the doming stations of the prior art tend to have a complicated structure to handle the loads experienced by the punch striking the dome die and require fine adjustment whenever the apparatus is stripped down for repair or maintenance.

SUMMARY OF THE INVENTION

According to the present invention, there is provided an apparatus for forming a base profile on a container mounted on a punch, the apparatus comprising a die having a face with a profile complimentary to that of the desired base profile, an adjustable hold down for clamping the container against the punch during forming of the base profile and means for biasing the die against the base of the container, arranged so that the die is moveable against the action of the biasing means as the punch reaches the end of its stroke, characterised in that the biasing means is a continuous annulus of resilient material and creates a uniform overtravel force as the punch reaches the end of its stroke.

As the hold down clamps the container against the punch, the base profile or dome is formed over the dome die. To ensure that the dome is fully formed and tolerance repeatability can be achieved, the punch must "bottom out" on the dome die. The die may typically be set forward of the end stroke of the punch to produce an overtravel to ensure that the punch bottoms out. The annular biasing means of the present invention provides a reaction or overtravel force as this overtravel occurs. The use of a continuous annulus of resilient material gives better force distribution than an array of independent elements which may vary in size, rating and amount of wear between individual elements. Such variations between the individual biasing elements causes uneven force distribution around the circumference of the dome die. Preferably, the biasing means comprises a polyurethane ring or a single steel spring.

Additionally, the present invention provides an apparatus for forming a base profile on a container mounted on a punch, the apparatus comprising a die having a face with a profile complimentary to that of the desired base profile and associated biasing means for biasing the die against the base of the container, and an adjustable hold down and associated biasing means for clamping the container against the punch during forming of the base profile; characterised in that the hold down biasing means is arranged surrounding the dome die.

By adapting the hold down biasing means so that it can be arranged around the dome die, in front of the support for the dome die, the apparatus of the invention is more compact than the prior art devices. Furthermore, as there is no requirement for transmission of forces from the hold down ring through or around the dome die support, transmission rods or pins are not required. This simplifies the construction of the apparatus and reduces the number of co-operating, moving parts which require bushes, bearings or seals. This in turn, reduces the number of consumable parts which are subject to wear and therefore require routine replacement.

Furthermore, as the hold down ring biasing mechanism is positioned around the dome die and there is no complex structure behind the dome die support, this arrangement facilitates easy removal of coolant from the dome die by means of a central bore which runs along the centre of the dome die and through the dome die support.

In a preferred embodiment of the invention, the hold down is enlarged to act as a piston which is biased by fluid pressure. The dome die support may then be adapted to provide the sealed piston chamber within which the hold down piston operates.

Preferably, the hold down is biased to eject the container after the base profile has been formed. The fluid pressure, which is adjustable, is typically air pressure which pushes the hold down forward after the forming operation, thereby ejecting the can from the dome tooling.

The apparatus may further comprise a sensor for detecting overtravel of the die. This sensor detects more than one thickness of material in the dome station such as when double feeds occur.

Preferably, the apparatus comprises an outer alignment ring in which the dome die, dome die support and hold down are mounted. The outer alignment ring is adjustable to ensure concentric alignment of the dome die with the punch. Once the outer alignment ring has been correctly aligned with the punch, the dome die, dome die support and hold down may be removed from the outer ring for inspection or maintenance without upsetting the alignment of the outer ring. When the dome die, dome die support and hold down are reinserted into the outer alignment ring, they self align within the outer ring. This arrangement simplifies maintenance procedures as the dome die, dome die support and hold down may be removed from the outer alignment ring and then reinserted without the need to realign the system. The outer alignment ring may be extended behind the dome die support and associated biasing means to form a housing for the dome die, dome die support and hold down.

Eccentric alignment means may be provided to adjust the orientation of the outer ring relative to the punch. These may comprise eccentric adjusters or pins which can be rotated from the rear of the dome door to align the outer ring with the punch, whilst the outer ring is located on the dome door but before the location bolts are fully tightened.

The apparatus may be adapted to be mounted in a dome door of a press by having a flanged housing, for example, which surrounds the domer and enables the domer to be locked onto the domer door. By mounting the domer in this way, cyclic loads are taken directly on the domer door rather than through bolts, thus avoiding component fatigue and risk of misalignment. None of the bolts used in the apparatus according to the invention are subjected to tensile loading during the doming operation.

The invention provides a simple and robust unit which can operate at high speed with reduced wear and simpler maintenance and alignment requirements than has been the case with prior art base forming apparatus.

Preferred embodiments of the invention will now be described, by way of example only, with reference to the drawings, in which:

DESCRIPTION OF THE PREFERRED EMBODIMENTS

Figure 1:
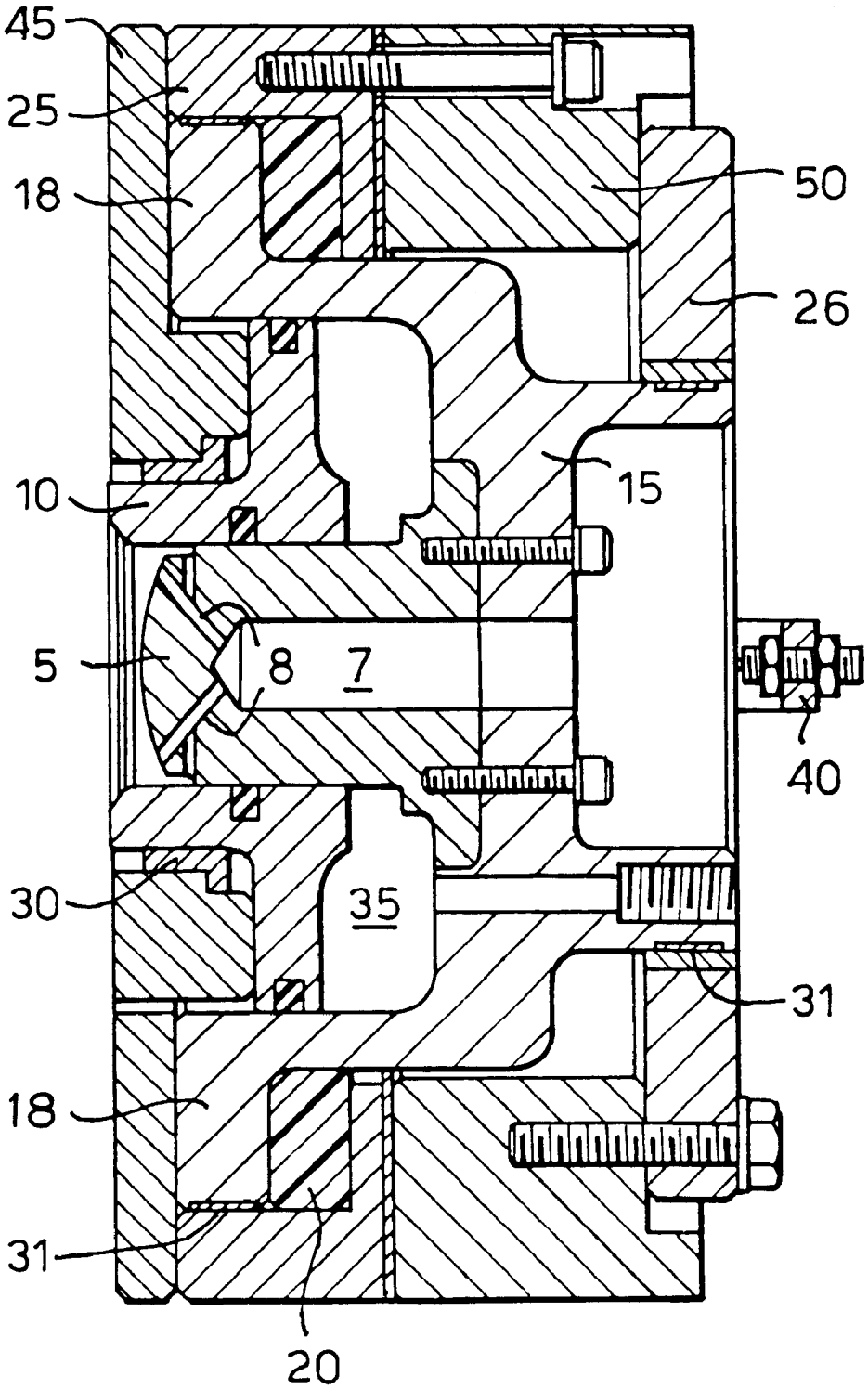
FIG. 1 is a side section of a first embodiment of base forming apparatus.

The embodiment of FIG. 1 comprises a dome shaped die 5 surrounded by and set back from a hold down ring 10. A dome die support 15 comprises a "top hat" shaped component having a flange 18 behind which is a polyurethane ring 20. This ring biases the dome die forwards towards the centre of the base of a can carried by a punch 85 (i.e. from right to left in the drawings, see in particular FIG. 3). The use of a complete ring ensures that there is symmetrical loading on the dome die without risk of misalignment during the forming operation.

The hold down ring 10 has an enlarged portion which acts as the piston in air piston 35 and the dome die support 15 defines the piston cylinder. The air piston 35 biases the hold down ring 10 towards an outer part of the base of the can. The hold down ring 10 is separated from a front retaining plate 45 by a bearing 30.

An outer ring 25 can be aligned prior to locking the domer onto a bodymaker by using, for example, eccentric adjusters which are located at an angle to the central axis of the ring so that both horizontal and vertical adjustments can be achieved. The front retaining plate 45 may be attached to the outer ring 25 using bolts, interlocking lugs, an annular clamp or other suitable fixing techniques.

Figure 4:
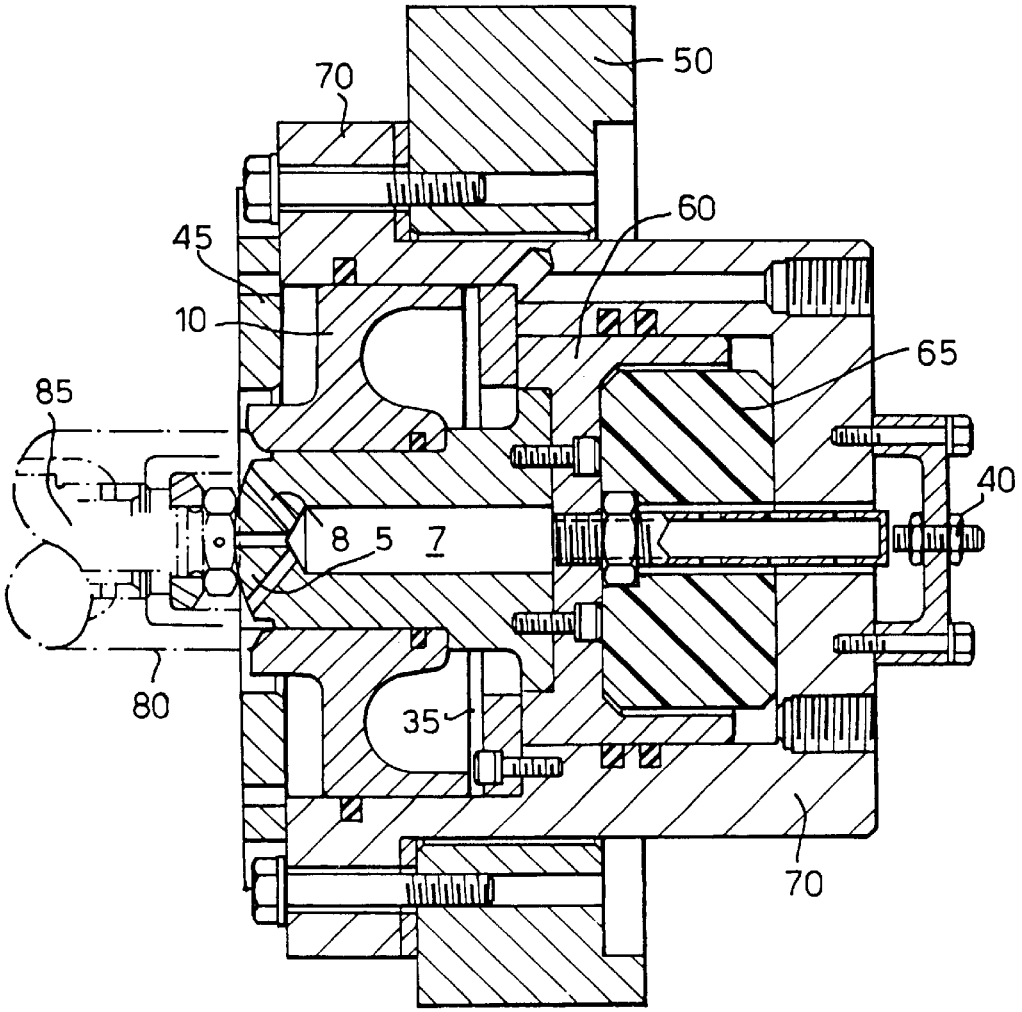
FIG. 4 is the side section of FIG. 2, with a can on a punch having a fully formed base.

As can be seen from FIG. 4, a dome station (unnumbered) is readily mountable onto a dome door 50 of a press (not shown). The loads from the punch, carrying the can, striking the hold down ring 10 and dome die 5 are transmitted directly into the dome door 50 via the flange 18. No loads are transmitted via the bolts holding the dome station in the dome door.

The dome station shown in FIG. 1 is easily dismantled for inspection and maintenance and then reassembled, without requiring re-alignment of the dome die 5 and hold down ring 10 in relation to the punch. Firstly, the front retaining plate 45 is removed from the outer ring 25 by removing the location bolts, twisting to release the co-operating lugs or releasing the clamp as appropriate. Bearing 30 remains located in the front retaining plate 45 when it is removed. The dome die support 15, with the dome die 5 and hold down ring 10 still retained therein, may then be removed from the assembly, providing access to the strip bearings 31 and polyurethane ring 20. Preferably, the strip bearings 31 are self lubricating and are either located in grooves in the outer ring 25 and back plate 26 or in grooves in the dome die support 15. The hold down ring 10 may be removed from the dome die support 15, providing access to the seals for the air piston 35. On reassembly, the dome die support 15 is aligned in the outer ring by the strip bearings 31 and the hold down ring 10 is aligned by the bearing 30 in the front retaining plate 45 and by the dome die 5. The front retaining plate 45 has an outer locating annulus which co-operates with a groove in the outer ring 25 to align the front retaining plate 45 with the outer ring 25. As the outer ring 25 has not been moved from the dome door 50, it remains aligned with the punch. The dome die 5 and hold down ring 10 self align with the punch due to the alignment of the dome die support 15 and front retaining plate 45 within the outer ring 25.

Figure 2:
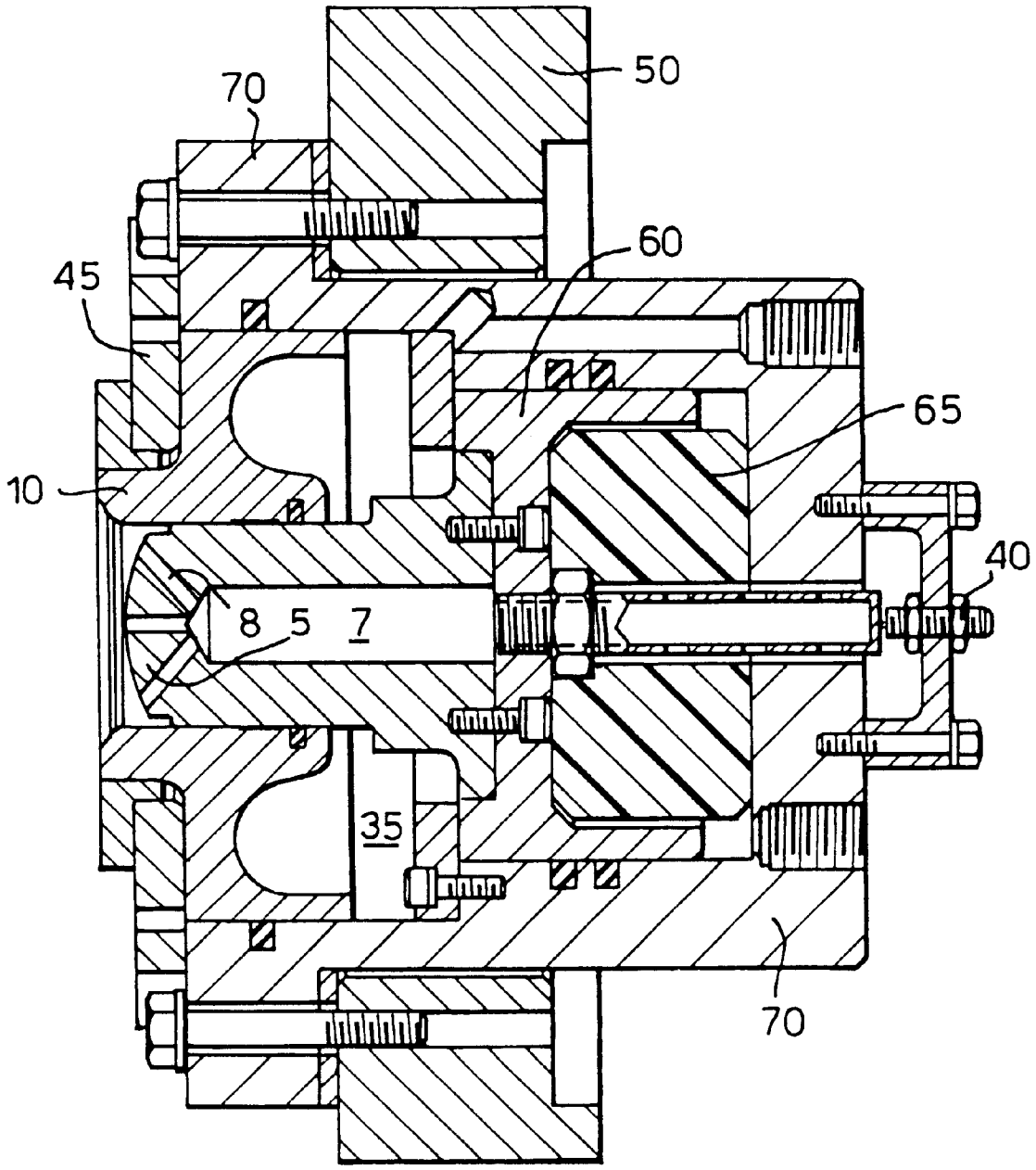
FIG. 2 is a side section of a second embodiment of base forming apparatus.

FIG. 2 shows a second embodiment of the invention with like components given the same references. However, in this embodiment, the dome die support 60 is positioned directly behind the die and annular polyurethane spring 65 is positioned behind the dome die support 60. The whole dome station is contained by a housing 70 which fits onto the dome door 50. The hold down ring 10 is enlarged in diameter, to provide the piston of air piston 35. The housing 70 defines the piston cylinder.

The embodiment of FIG. 2 is more robust than that of FIG. 1 and so is best suited for forming the base on a steel can. However, since there is less friction resistance in the first embodiment, and consequently less heat generated, that embodiment is ideally suited for forming the base on an aluminum can but could also be used for steel cans.

The dome station of FIG. 2 is easy to dismantle for inspection and maintenance, without affecting the alignment of the dome die. 5 and hold down ring 10 in relation to the punch. The housing 70 is accurately aligned with the punch and access to the dome die 5, dome die support 60 and hold down ring 10 may be obtained without affecting the alignment of the housing 70. The front retaining plate 45 is removed, as previously discussed in relation to FIG. 1, and the hold down ring 10, dome die 5 and dome die support 60 may be removed from the housing 70, providing access to the polyurethane ring 65 and the seals for the air piston 35.

Figure 3:
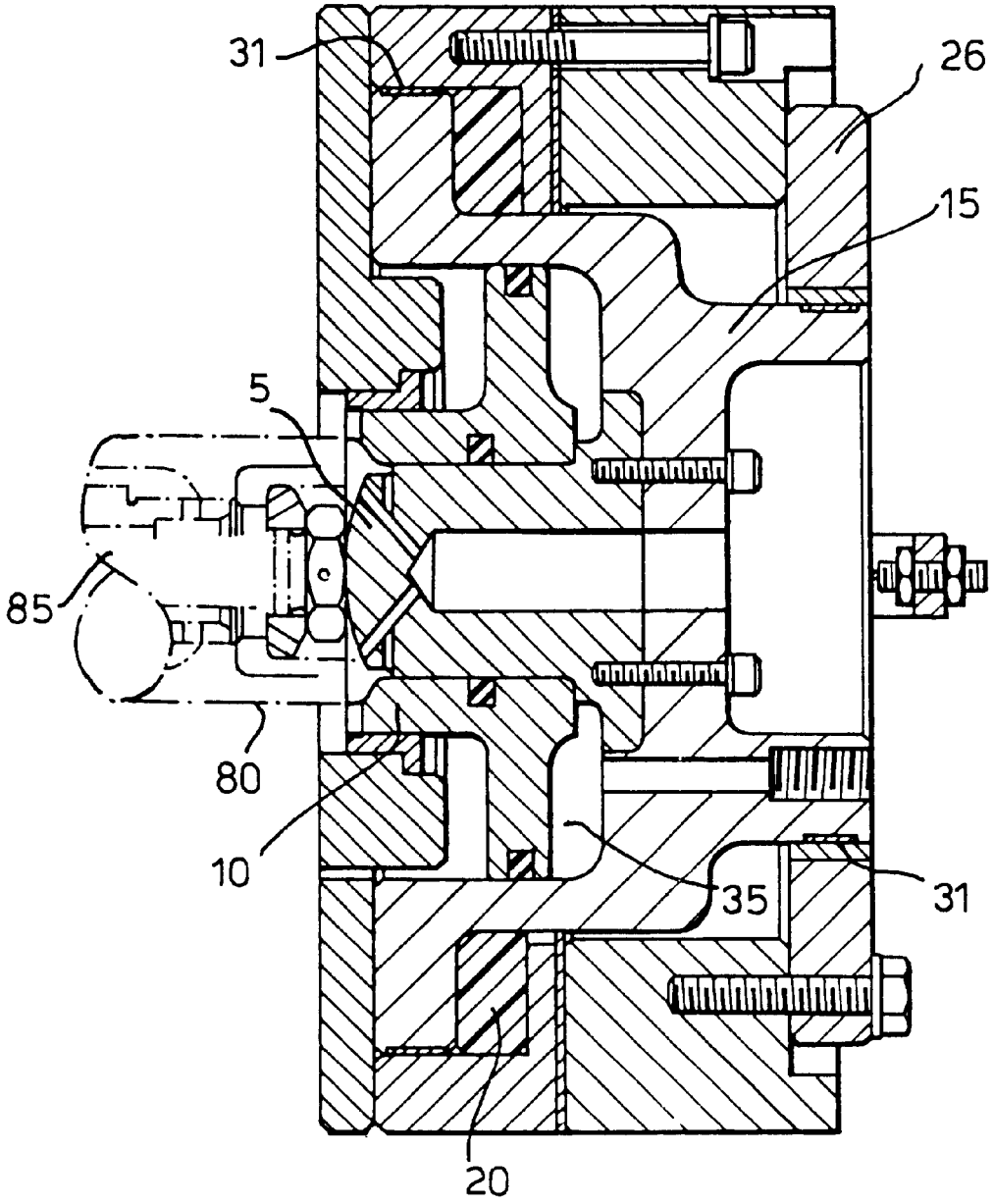
FIG. 3 is the side section of FIG. 1, with a can on a punch having a fully formed base.

FIGS. 3 and 4 show the two types of dome station with a can 80 carried by a punch 85 in the position at which the dome has been fully formed.

In order to form a dome on the base of a can 80 carried by the punch 85, the hold down ring 10 first clamps the metal of the can body between itself and the punch. In this state the hold down ring, driven by the punch, moves back from the position shown in FIG. 1, against fluid pressure, to that of FIG. 3 (and similarly for FIGS. 2 and 4). In order to achieve the final definition of the dome, the hold down ring 10 bottoms out against the dome die 5, which is initially set forward of the end stroke of the punch, and will move by a small overtravel, thereby compressing the polyurethane ring 20. Compression of the polyurethane ring 20 thus provides a symmetrical reaction or overtravel force.

Once the dome has been fully formed and the punch is driven back by the bodymaker, the air cylinder 35 pushes the hold down ring 10 forward and assists in ejection of the can. The large diameter of the hold down ring 10 provides a large surface area in cylinder 35 for ease of pressure control and increased hold down force. The cylinder 35 is operated by means of a pressurised fluid supply fed through a small accumulator close to the unit (not shown). This ensures that a consistent force is applied as the hold down ring 10 reduces the cylinder volume during the formation of the dome.

If there is more than one thickness of material in the dome station, for example if there has been a double feed of cans, then the sensor 40 detects this and stops the bodymaker, ejecting the can from the tooling.

As the dome is formed, a large force acts on the dome station. In conventional dome stations, this force is taken by bolts which are used to mount the domer. However, in the present invention, the domer is mounted directly onto the dome door so that the load from the whole unit is taken directly on the dome door rather than through bolts. This minimises any risk of failure of the domer due to cyclic loads taken solely on the bolts.

Figure 5:
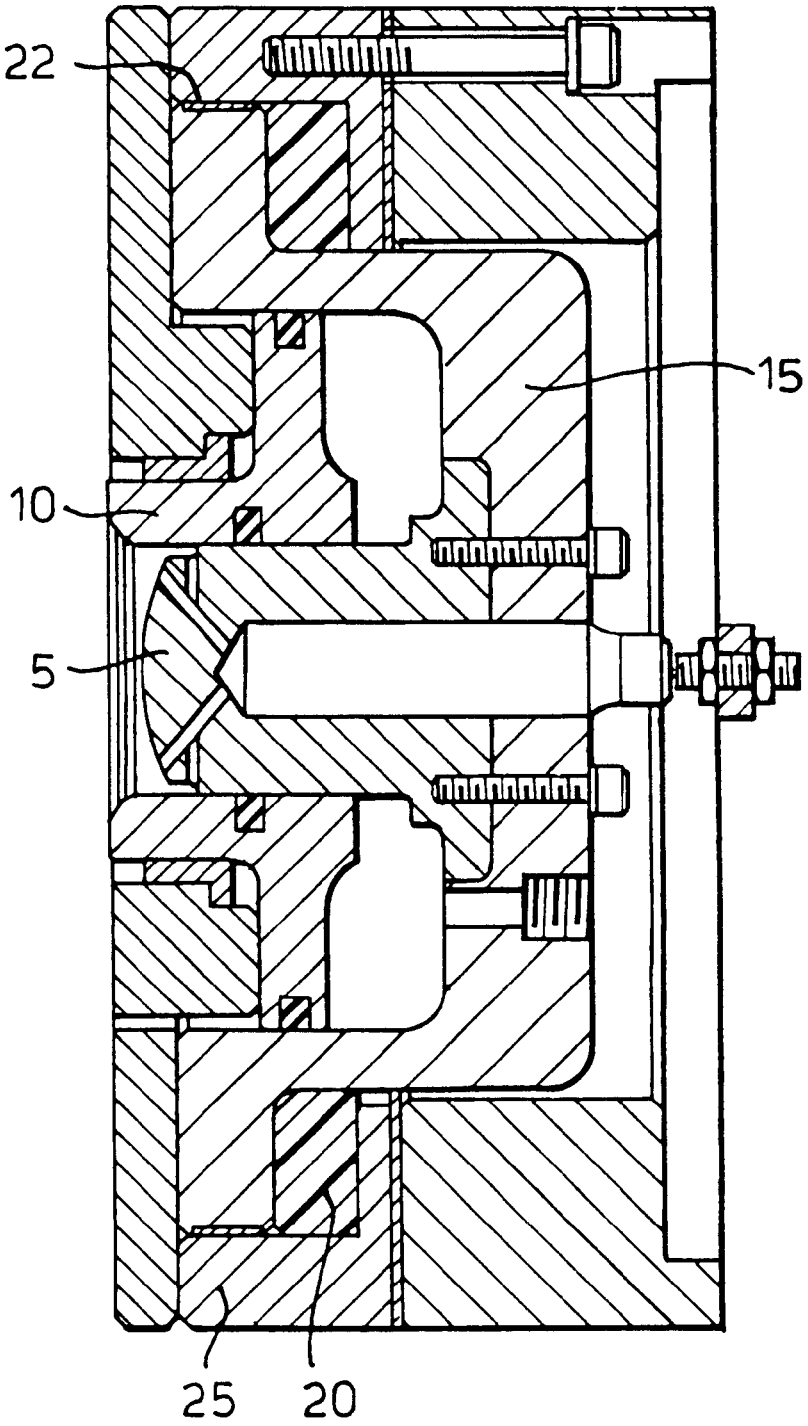
FIG. 5 is a side section of a third embodiment of base forming apparatus.

A further embodiment which improves load distribution is shown in FIG. 5. The dome station of this embodiment is similar to that of FIGS. 1 and 3 and uses the same reference numerals where appropriate. The bearing support at the rear of the dome station of FIG. 1 is removed in the variant of FIG. 5. The dome die support 15 is then able to rotate slightly about plain bearing 22. It is believed that this feature may have the advantage of distributing the load more evenly throughout the dome die support 15, should the punch and domer be misaligned, thereby reducing the risk of failure through over-stressing or fatigue.

The harmonics of the apparatus of FIG. 1 are improved by carrying out the modification of FIG. 5 since the dome die of FIG. 5 is allowed to follow the centre line of the punch as a dome is produced. This reduces oscillations of the ram after the dome has been formed, i.e. on the return stroke, and consequently reduces machine vibrations and increases tool life.

The embodiment shown in FIG. 5 may be modified further by removing the plain bearing 22 and providing an arcuate surface on the extremity of the flange on the dome die support 15 where it contacts the outer ring 25. The arcuate contact surface allows controlled rocking of the dome die support 15 within the outer ring 25, to correct misalignment between the dome die 5 and hold down ring 10 and the punch.

It can be seen that the dome stations described are much simpler than known dome stations, having fewer moving parts and fewer and simpler bearings. This means that the domers are less subject to dome maintenance requirements. Furthermore, there are, overall, fewer components which are lightweight where possible and yet which are still robust enough to operate at can making speeds of typically 500 cans per minute. For example, the dome die support 15 may be made from aluminum, single components are used to limit wear and components have been wasted where possible.

The dome stations of FIGS. 1 and 5 are particularly easy to maintain, in contrast with known domers. Specifically, the front retaining plate 45 is removable and then the domer can be stripped down in situ on the dome door. Only the outer ring 25 need remain in place since this is set up concentric by means of eccentric bushes as described above. Provided that this outer ring remains set up, the other domer components simply fit into this and self align without disturbing the initial machine set-up.

It will be appreciated that the invention has been described above by way of example only and that changes may be made within the scope of the invention as defined by the claims.

What is claimed is:

1. An apparatus for forming a base profile on a container end of a container adapted to be mounted on a punch during a forming operation comprising:

a die (5) including a central portion having a forming face profiled complementary to a desired base profile of a container end;

an adjustable hold down (10) in exterior telescopic relationship to said die (5) for clamping a container against a punch during movement of the punch in a predetermined forming direction to form a container end to a desired base profile;

fluidic biasing means (35) in exterior surrounding relationship to said central die portion for biasing said adjustable hold down (10) into clamping engagement with a container carried by the punch;

means (20, 65) in exterior substantially concentric opposing relationship to said die (5) for biasing the die (5) against the container end in a direction opposing the predetermined forming direction of the punch; and said die biasing means (20, 65) being a continuous annular member made of resilient material which creates a uniformed biasing force during movement of a punch in its predetermined forming direction toward the end of its stroke.

2. The apparatus as defined in claim 1 wherein said die biasing means (20, 65) is made of polyurethane.

3. The apparatus as define in claim 1 wherein said die biasing means (20, 65) is made of spring steel.

4. The apparatus as defined in claim 1 including a press dome door (50), and said dome door (50) is configured and arranged to absorb loads form said die (5) and hold down (10).

5. The apparatus as defined in claim 1 including seat defining means (70) fit to a dome door (50) of a press.

6. The apparatus as defined in claim 1 including means (25, 70) for substantially concentrically aligning the die (5) and the hold down (10) relative to each other.

7. The apparatus as defined in claim 1 including means (25, 70) for substantially concentrically aligning the die (5) and the hold down (10) relative to each other, and means for adjusting the aligning means (25, 70) relative to an associated punch to effect substantial concentricity between the punch, die (5) and hold down (10).

8. The apparatus as defined in claim 1 including means mounting said die (5) for rocking movement relative to a longitudinal axis of said die (5).

9. The apparatus as defined in claim 1 wherein said die (5) includes a die support (15) having a flange (18), and said annular member (20) is sandwiched between said flange (18) and a seat (50).

10. The apparatus as defined in claim 1 wherein said annular member (65) is disposed at an end portion of said die (5) remote from said forming face, and said annular member (65) is sandwiched between said remote end portion and a seat (70).

11. The apparatus as defined in claim 1 wherein said hold down (10) and a die support (15) define a chamber for said fluidic biasing means (35), and said annular member (20, 65) is in substantially concentric relationship to said fluidic biasing means (35).

12. The apparatus as defined in claim 1 wherein said hold down (10) and a die support (15) define a chamber for said fluidic biasing means (35), and said annular member (20) is in exterior substantially concentric surrounding relationship to said fluidic biasing means (35).

13. The apparatus as defined in claim 1 wherein said die (5) includes a die support (15) having said central portion, a peripheral skirt and a radially outwardly directed flange (18) collectively defining with said hold down (10) a chamber for said fluidic biasing means (35), and said annular member (20) is sandwiched between said flange (18) and a dome door (50).

14. The apparatus as defined in claim 1 wherein said die (5) includes a die support (60) having said central portion and a peripheral skirt defining a chamber opening in a direction away from said forming face, and said resilient annular member (65) is housed in said chamber.

15. The apparatus as defined in claim 1 wherein said die (5) includes two independent parts between which is located a spacer to vary the height of the desired base profile.

16. The apparatus as defined in claim 1 wherein said fluidic biasing means (35) is arranged surrounding the die (5).

17. The apparatus as defined in claim 1 wherein said hold down (10) functions to eject the container after the base profile has been formed.

18. The apparatus as defined in claim 1 including a dome door (50), and means for mounting said die (5), said hold down (10), said fluidic biasing means (35), and said resilient annular member (20, 65) upon said dome door (50).

19. The apparatus as defined in claim 1 including bearing means (30) for effecting supporting movement of said hold down (10).

* * * * *